United States Patent [19]

Balint et al.

[11] 4,424,603

[45] Jan. 10, 1984

[54] EDGING DEVICE FOR A PAINT TOOL

[75] Inventors: Peter Balint, Milwaukee; Fredrick B. Burns, South Milwaukee; Howard R. Moon, Fort Atkinson, all of Wis.

[73] Assignee: Ez Paintr Corporation, Milwaukee, Wis.

[21] Appl. No.: 355,904

[22] Filed: Mar. 8, 1982

[51] Int. Cl.[3] ..... B05C 17/00

[52] U.S. Cl. ..... 15/210 R; 15/246

[58] Field of Search ..... 15/166, 160, 209 R, 15/210 R, 246, 248 R

[56] References Cited

U.S. PATENT DOCUMENTS

| | | | |
|---|---|---|---|
| 2,797,427 | 7/1957 | Tate | 15/246 X |
| 2,837,757 | 6/1958 | Katanich | 15/246 |
| 3,042,952 | 7/1962 | Bradley | 15/210 R |
| 3,599,265 | 8/1971 | D'Ercoli | 15/210 R |
| 3,605,165 | 9/1971 | Burns | 15/210 R |
| 3,708,821 | 1/1973 | Chase et al. | 15/210 R |

*Primary Examiner*—Edward L. Roberts

*Attorney, Agent, or Firm*—McDermott, Will & Emery

[57] ABSTRACT

A paint tool includes a base with at least two sides and a handle secured thereto. An edging device is pivotally and removably mounted on the tool and includes a plate with a slot. At least one position is defined in the slot by an enlargement of the width of the slot. First and second wheels are rotatably mounted in tandem on the plate and the plate may be secured to either side of the base and will pivot upon securement to allow an edge to be painted on a surface.

14 Claims, 5 Drawing Figures

EDGING DEVICE FOR A PAINT TOOL

BACKGROUND OF THE INVENTION

1. Field of the Invention

The present invention relates to a new and improved edging device for a paint applying tool and the like.

2. Brief Description of the Prior Art

One of the more difficult tasks in painting a surface is to edge around an object or another surface. For example, while painting a wall, it is often difficult to edge around a door or window frame. Many different devices exist in the prior art to assist in edging a surface or to perform the edging operation. Edging shields, for example, are available and are placed against or around the surface that is not to be painted and paint is applied up to the shield. The typical prior art shield, however, oftentimes allows paint to seep beneath it resulting in a ragged or uneven edge.

Other types of prior art devices use a roller that allows the paint applying tool to move along the surface to be painted and the roller engages the surface against which an edge is to be applied. The roller prevents the tool from abutting directly against the surface that is not to be painted, thus, allowing an edge to be painted. Such an edging device is illustrated in the U.S. Pat. Nos. 3,042,952, 3,359,589 and 3,708,821. These prior art devices, however, include rollers only on one side of the tool thus limiting the utility of the device. In those tools that include rollers on both sides of the tool, the rollers are fixed and cannot accommodate different size paint pads. Tools including rollers on both sides are illustrated in U.S. Pat. Nos. 3,599,265 and 3,605,165. The edging rollers on these prior art tools are permanent thus preventing their use in applications where an edging roller is not desired.

It is desirable to provide an edging tool that can accommodate different sized paint pads and is adaptable for use on either side of the paint tool.

SUMMARY OF THE INVENTION

An object of the present invention is to provide a new and improved device for painting a surface.

Another object of the present invention is to provide a new and improved edging device for a painting tool.

Briefly, the present invention is directed to a new and improved painting tool and an edging device that may be pivotally mounted on either side of the painting tool to allow an edge of a desired width to be painted a selected distance from a surface. The painting tool of the present invention includes a base with at least two sides and a handle connected thereto. A painting pad is also connected to the base. The base includes first and second posts fabricated thereon adjacent to the sides of the tool. The edging device includes a plate or housing with a slot within which is defined at least a first position by an enlargement in the width of the slot. One of the posts on the base of the painting tool is intended to be located within the first positions. In this manner the plate may be removably placed on the post and pivoted thereabout. First and second rollers are rotatably mounted on the plate and on opposite sides of the slot.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DESCRIPTION OF THE PREFERRED EMBODIMENT

Figure 1:
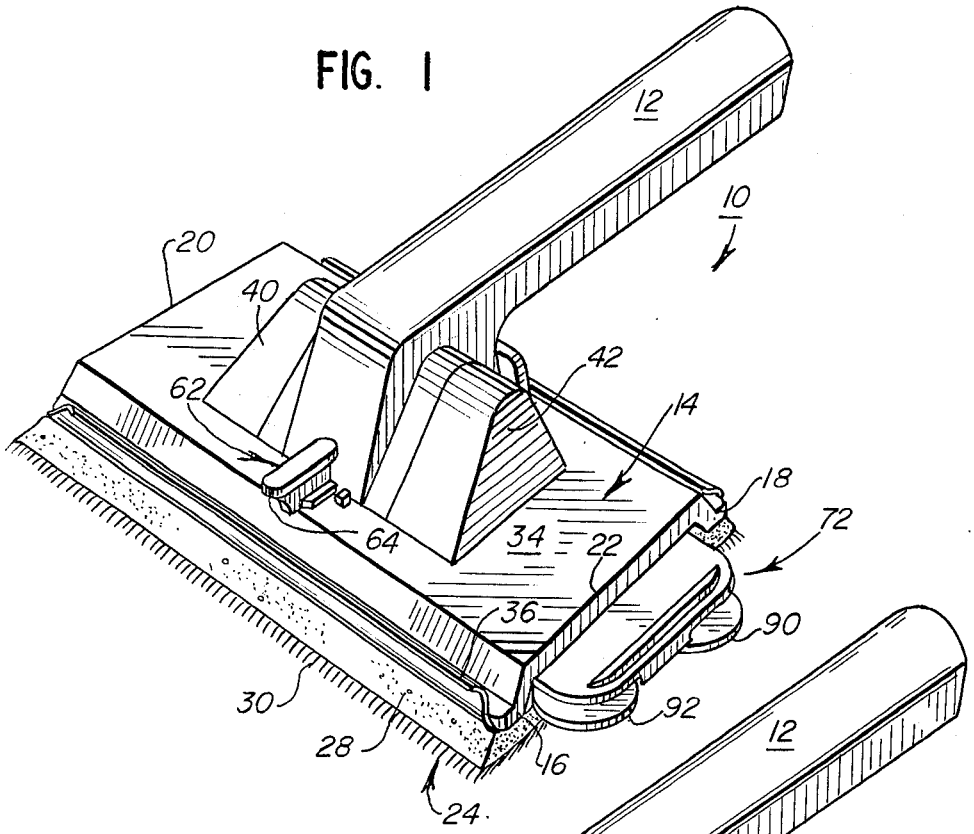
FIG. 1 is a perspective view of a paint tool constructed in accordance with the principles of the present invention.
Figure 2:
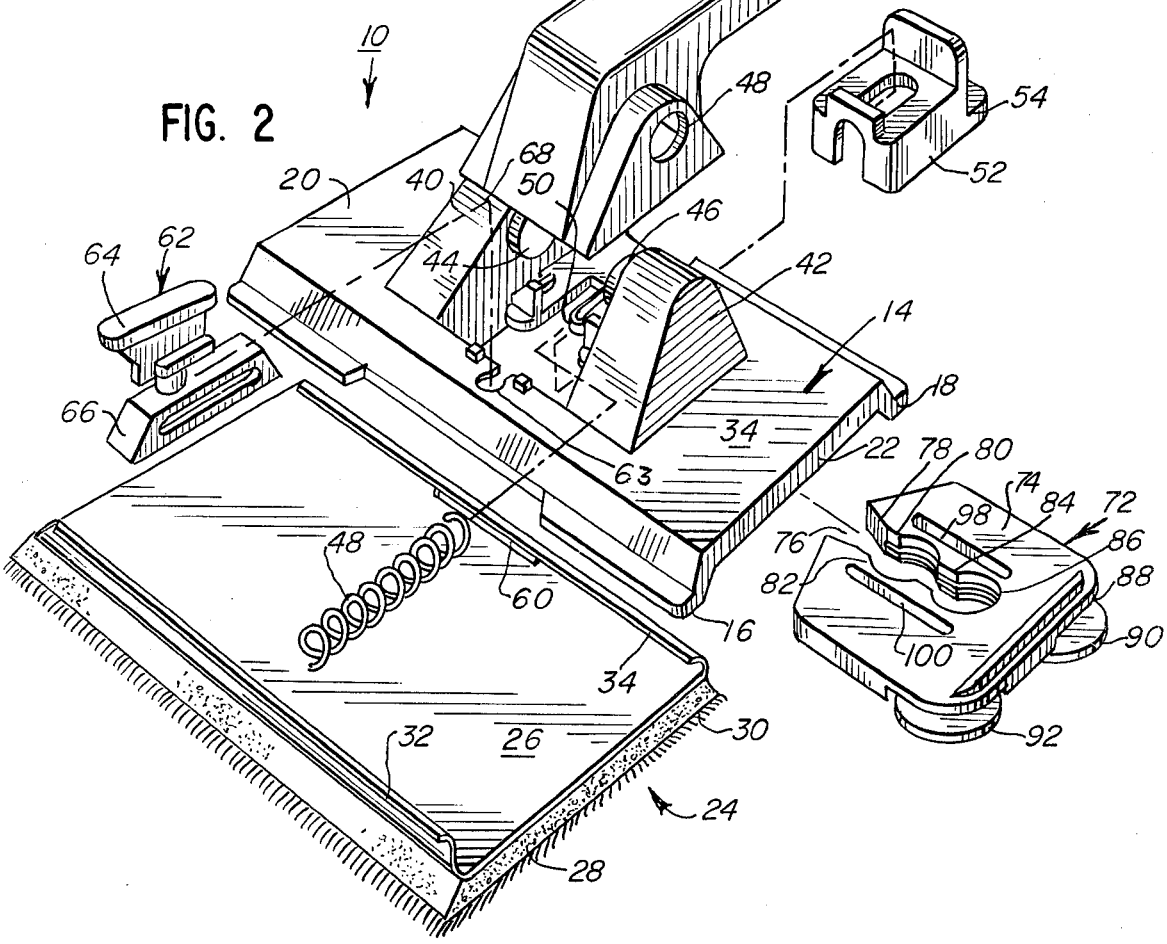
FIG. 2 is an exploded perspective view of the tool illustrated in FIG. 1.

Referring initially to FIG. 1 there is illustrated a paint applying tool generally designated by the reference numeral 10 and constructed in accordance with the principles of the present invention.

The tool 10 includes a handle 12 pivotally connected to an applicator or base member generally designated by the reference numeral 14. The handle 12 may be hollow and internally threaded to allow the securement of an extension pole thereto. The base member or applicator is generally trapezoidal in configuration and includes front 16 and rear 18 edges and sides 20 and 22. Secured to the base is an applicator pad generally designated by the reference numeral 24 that includes a metallic backing plate 26 and a foam pad 28 secured thereto. A nylon fiber fabric, mohair or similar material 30 is secured to the face of the foam pad 28. The backing plate 26 includes a front edge or flange 32 that slides along and over the front 16 of the base 14. The backing plate 26 also includes a rear flange 34 that sits in a similar manner over the back 18 of the base 14 thereby removably securing the backing plate 26 and the foam applicator 28 and 30 to the base 14. The applicator 28 and 30 may be dipped into paint to apply paint to a surface.

Figure 3:
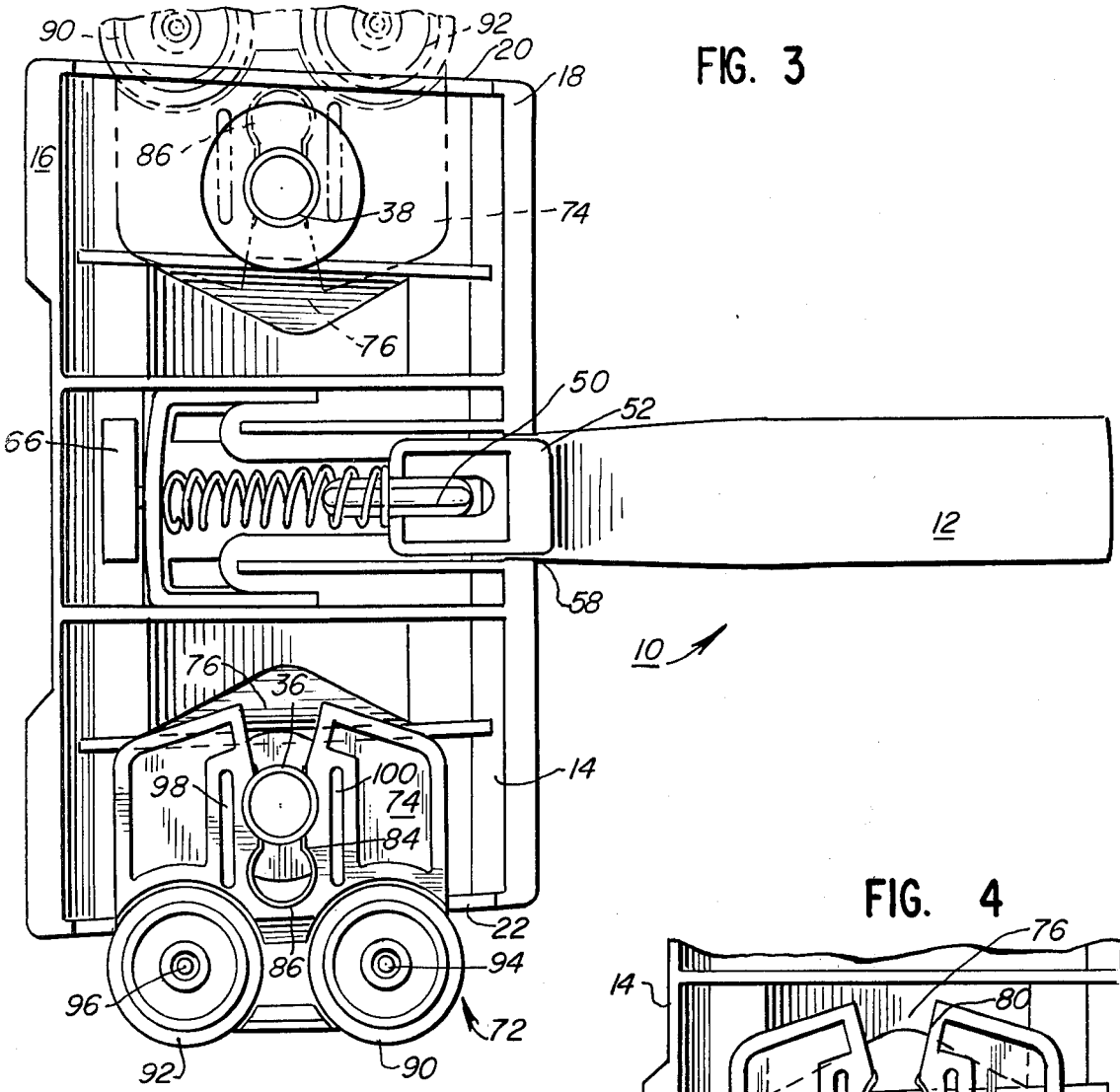
FIG. 3 is a partially cross sectional plan view of the tool of the present invention with an edging device in a first position.
Figure 4:
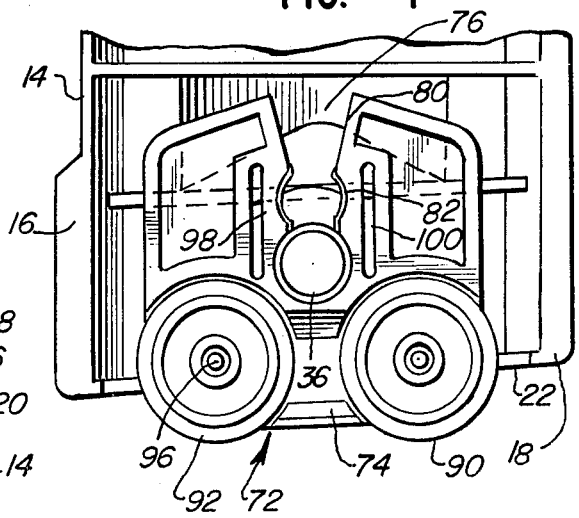
FIG. 4 is a partial, plan cross sectional view of the tool with the edging device in a second position.

The base 14 is formed such that a central portion 34 is raised relative to the front 16 and rear 18 edges of the base. Thus, once the applicator pad 28 and 30 and the metallic backing member 26 are secured to the base 14 a space is defined between the central portion 34 of the base 14 and the backing plate 26. As best illustrated in FIGS. 3 and 4 integral posts 36 and 38 are defined on the lower peripheral surface of the base 14. The handle 12 is pivotally attached to the base 14 between uprights 40 and 42 defined on the base 14 through the employment of integral pins 44 and 46 defined thereon and extending through apertures 48 fabricated on each side of the handle portion 12.

The handle 12 is biased to the position illustrated in FIG. 1 by a spring 48 that at one end is biased against the handle 12 and the other end encircles an integral pin 50 fabricated on the underside of the base 14. A locking member 52 is positioned about the pin 50 and is biased to the position illustrated in FIG. 3 by the spring 48. The locking member 52 includes an extension 54 that extends through a slot 58 defined in the back 18 of the base 14. This slot 58 extends adjacent an opening 60 in the metallic backing plate 26. Upon complete placement of the backing plate 26 on the base 14 the extension 54 extends through the slot 58 and the opening 60 thereby locking the backing plate 26 and the applicator 24 in position.

Pivotal movement of the handle 12 is controlled by a locking member 62 that extends through an aperture 63 defined in the base 14. The lock 62 includes a handle portion 64 that may be gripped and rotated to rotate an abutment member 66 that in a first position illustrated in FIG. 1 extends beneath the lower front edge 68 of the handle 12 and prevents downward pivoting or counterclockwise rotation of the handle 12 relative to the base 14. In a second position illustrated in FIG. 3, the abutment portion 66 is out of engagement with the front edge 68 of the handle 12 allowing the handle 12 to be pivoted relative to the base 14. In this manner, the handle 12 may be pivoted while the base 14 and applicator 24 remain on the surface being painted, thus allowing easier use of the tool 10. For a more detailed description of the tool 10 and the various components described above, reference should be made to U.S. Pat. No. 3,599,265 and this patent is incorporated by reference herein.

Figure 5:
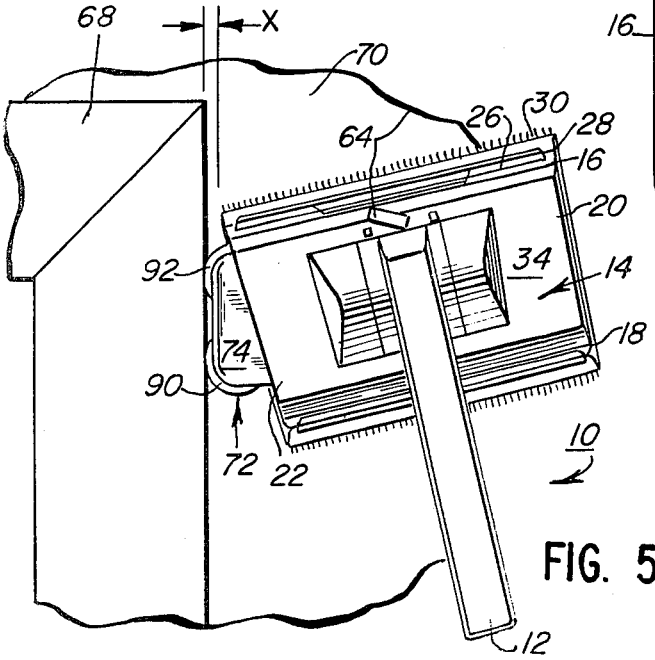
FIG. 5 is a view of the tool being used to paint a surface.

It is desirable that the tool 10 may not only be employed on surfaces such as walls but may also be employed in areas adjacent to other surfaces where an edge is desired to be painted. For example, an edge may be desired to be painted around a door frame 68 as illustrated in FIG. 5 while painting the wall 70 also illustrated in FIG. 5. To accomplish the edging desired, the tool 10 includes an edging device or cartridge generally designated by the reference numeral 72. The edging device 72 includes a plate or housing 74 with a central slot 76. The entrance of the slot 78 is bevelled to a reduced portion 80. Forward of the reduced portion 80 is an enlarged circular area 82 followed by a second reduced area or portion 84 thereafter followed by another enlarged circular area 86. Enlarged and reduced are used to describe the various portions 80, 82, 84 and 86. It is to be understood that these refer to enlargement or reduction of the width of the slot 76.

It is the intention of the edging device 72 to be positioned on either of the posts 36 and 38. As illustrated in FIGS. 3 and 4 the edging device 72 is secured to the tool 10 by inserting the edging device 72 into the space between the upraised portion or platform 34 and the metal backing plate 26 such that the slot 76 and specifically the bevelled sides 78 engage for example, the post 36. Upon pressure being applied, the post 36 moves into the slot 76 and snaps beyond the reduced portion 80 into the first position or the enlarged portion 82 as illustrated in FIG. 3. Upon further pressure being applied the post 36 moves past the second reduced portion 82 into a second position or the enlarged area 86 illustrated in FIG. 4. It should be understood that the edging device 72 may be mounted on post 36 or on post 38 as illustrated in dotted lines in FIG. 3.

Mounted on the front edge 88 of the edging device 72 are a pair of rollers 90 and 92 that are mounted by pins 94 and 96, respectively, and rotatably mounted in tandem on opposite sides of the slot 76. As best seen in FIGS. 3 and 4 the edging device 72 is mounted on the base 14 so as to allow pivoting motion about either of the posts 36 or 38. This is accomplished by the fact that the plate 74 is held onto either of the posts 36 or 38 by a spring-like force created by the resiliency of the material from which the base 74 is made and by the provision of slots 98 and 100 provided in the plate 74 that are spaced slightly outwardly from the slot 76. The material between the slot 76 and the slots 98 and 100 bend slightly resulting in a spring-like or clamping force on either of the posts 36 and 38. The provision of two rollers 90 and 92 provide greater stability of the edging device 72 during use as opposed to prior art edging devices that have a single roller. This greater stability results in a more even edge being applied to a surface. Moreover, due to the two positions defined by the enlarged portions 82 and 86 on the plate 74, the edging device 72 may be used for different sized applicators 24. The applicator 24 illustrated with the tool 10 of the present invention is of a size such that either the post 36 or 38 may be positioned in the second enlargement 86; however, if an applicator 24 of a greater width that extends beyond the sides 20 and 22 of the base 14 is used, the posts 36 or 38 may be positioned in the first enlargement 82 of the slot 76 such as illustrated in FIG. 3. In this position the rollers 90 and 92 extend outwardly from the base 14 and accommodate the larger applicator 24.

In addition, as can be understood, the edging device 74 may be used on either side 20 or 22 of the tool 10 thereby increasing the utility of the edging device 72 and the tool 10. The edging device 72 is removable, as described, to allow cleaning or replacement thereof. Moreover, since the edging device 72 may pivot relative to the post 36 and 38, an edge may be applied at a selected distance from a surface. For example, with reference to FIG. 5, the edging device 72 and specifically the rollers 90 and 92 may be placed against the door frame 68. Thereafter, the tool 10 may be pivoted relative to the edging device 72 such that the forward corner of the applicator 24 may be positioned a predetermined distance X from the door frame 68. The tool 10 may then be moved smoothly downwardly through the interaction of the rollers 90 and 92 with the door frame 68 resulting in an edge at a constant distance X from the door frame 68. As can be understood the distance X may be varied by pivoting the tool 10 relative to the edging device 72.

What is claimed and sought to be secured by United States Letters patent is:

1. An edging cartridge for a paint applying tool, wherein said tool includes a base with a front, a back and first and second sides, and a handle secured to said base, said cartridge comprising:

a pivot arm, means for pivotally securing said pivot arm on one end to said base to allow said arm to pivot relative to said base, and a pair of wheels rotatably mounted in tandem on the other end of said arm, each wheel rotatable about an axis spaced from the axis of rotation of the other wheel and both wheels pivotable with said arm about said base.

2. The edging cartridge claimed in claim 1 wherein said securing means comprises an elongated slot defined in said arm with first and second positions in said slot defined by first and second enlargements of the width of said slot.

3. The edging cartridge claimed in claim 1 further comprising first and second posts defined on said base adjacent said first and second sides, respectively, said edging cartridge being mounted on either of said first and second posts.

4. The edging cartridge of claim 1 wherein said pivot arm is removably secured to said base.

5. In a paint applying tool of the type including a base with a front, a back, and first and second sides, a gripping member pivotally connected to said base, a pad for applying paint to a surface, secured to said base, the improvement comprising:

an edging cartridge removably connectable to said base and including a housing, and locking means for selectively varying the extension of said cartridge from said base by retaining said cartridge in one of at least two positions in response to the manual, linear displacement of said cartridge relative to said base said locking means including a slot and a post receivable within said slot, one of said slot and post mounted on said base and the other mounted on said cartridge.

6. The tool set forth in claim 5 further comprising first and second posts defined on said base adjacent said first and second sides, respectively, said cartridge being removably mounted on either of said first and second posts.

7. The tool set forth in claim 5 wherein said edging cartridge may pivot relative to said base upon being mounted thereon.

8. The tool set forth in claim 5 wherein said post is resiliently gripped within said slot.

9. A paint applying tool including a base with at least two sides, a handle secured to said base, first and second posts defined on said base adjacent said first and second sides, respectively, said tool comprising:

a plate pivotally connected to one of said posts and extending outwardly of said base, first and second rollers rotatably mounted in tandem on said plate, a slot fabricated in said plate between said first and second rollers, and first and second areas in said slot wherein said areas are defined by first and second enlargements in the width of said slot, said areas arranged to engage either of said posts.

10. In a paint applying tool of the type including a base with a front, a back, and first and second sides, a gripping member pivotally connected to said base, a pad for applying paint to a surface, secured to said base, the improvement comprising:

an edging cartridge removably connectable to said base and including a housing, locking means for selectively varying the extension of said cartridge from said base by retaining said cartridge in one of at least two positions in response to the manual, linear displacement of said cartridge relative to said base, said locking means including a slot and a post receivable within said slot, one of said slot and post mounted on said base and the other mounted on said cartridge, and first and second wheels rotatably mounted in tandem on said housing of said cartridge on opposite sides of said slot.

11. The tool set forth in claim 10, said locking means further comprising first and second enlargements along said slot defining first and second positions of said cartridge, said post being lockable within either of said enlargements and slideable along said slot from one enlargement to the other.

12. In a paint applying tool of the type including a base with a front, a back, and first and second sides, a gripping member pivotally connected to said base, a pad for applying paint to a surface, secured to said base, the improvement comprising:

an edging cartridge removably connectable to said base and including a housing, and locking means for selectively varying the extension of said cartridge from said base by retaining said cartridge in one of at least two positions in response to the manual, linear displacement of said cartridge relative to said base, said locking means including a slot and a post receivable within said slot, one of said slot and post mounted on said base and the other mounted on said cartridge, said locking means further comprising first and second enlargements along said slot defining first and second positions of said cartridge, said post being lockable within either of said enlargements and slideable along said slot from one enlargement to the other.

13. The tool set forth in claim 12 further comprising first and second wheels rotatably mounted in tandem on said housing of said cartridge on opposite sides of said slot.

14. In a paint applying tool of the type including a base with a front, a back, and first and second sides, a gripping member pivotally connected to said base, a pad for applying paint to a surface, secured to said base, the improvement comprising:

an edging cartridge removably connectable to said base and including a housing, said cartridge being pivotable relative to said base upon being mounted thereon, and locking means for selectively varying the extension of said cartridge from said base by retaining said cartridge in one of at least two positions in response to the manual, linear displacement of said cartridge relative to said base.

* * * * *